US011592253B1

(12) United States Patent
Schmid

(10) Patent No.: US 11,592,253 B1
(45) Date of Patent: Feb. 28, 2023

(54) SHORT-RANGE WIRELESS ELECTRONIC LOCK

(71) Applicant: Dylan Schmid, South Kingston, RI (US)

(72) Inventor: Dylan Schmid, South Kingston, RI (US)

( * ) Notice: Subject to any disclaimer, the term of this patent is extended or adjusted under 35 U.S.C. 154(b) by 0 days.

(21) Appl. No.: 17/509,952

(22) Filed: Oct. 25, 2021

(51) Int. Cl.
*F41A 17/06* (2006.01)
*G08C 17/00* (2006.01)

(52) U.S. Cl.
CPC ..... *F41A 17/063* (2013.01); *G08C 17/00* (2013.01); *G08C 2201/93* (2013.01)

(58) Field of Classification Search
CPC ..... F41A 17/02; F41A 17/04; F41A 17/06; F41A 17/46; F41A 23/005; F41A 23/50; G08C 17/00; G08C 2201/93
See application file for complete search history.

(56) References Cited

U.S. PATENT DOCUMENTS 835,349 A * 11/1906 Deming ..... F41A 17/74 42/70.11
3,624,945 A * 12/1971 Foote ..... F41A 17/02 42/70.07
4,392,318 A * 7/1983 Daniels ..... F41A 17/74 42/70.11
4,395,837 A * 8/1983 Durnal ..... F41A 17/54 42/70.11
4,509,281 A * 4/1985 Dreiling ..... F41A 17/54 42/70.07
4,624,372 A * 11/1986 Brolin ..... F41A 17/02 42/70.11
4,934,083 A * 6/1990 Smith ..... F41A 17/54 42/70.07
4,961,277 A * 10/1990 Rosenbaum ..... F41A 17/44 42/70.11
5,261,177 A * 11/1993 Armstrong ..... F41A 17/74 42/70.11
5,458,267 A * 10/1995 Curtis ..... A45F 5/02 24/324
5,551,181 A * 9/1996 Upton ..... F41A 17/54 42/70.07
6,044,669 A * 4/2000 Levi ..... B62H 5/00 292/307 R
6,568,117 B2 * 5/2003 Weinraub ..... F41A 17/54 42/70.07

(Continued)

*Primary Examiner* — Joshua E Freeman
(74) *Attorney, Agent, or Firm* — Lyman Moulton, Esq.; Moulton Patents, PLLC

(57) ABSTRACT

The present disclosure provides a Bluetooth operated lock for a trigger or a sheath. It is designed to limit the users' access to the use of the firearm. The only way to release the lock is through a wireless signal from a cell phone or another remote device. The disclosure includes a band having a first end and a second end configured to form a continuous loop around a firearm handle inside or outside the trigger. The disclosure also includes a locking mechanism connecting the first end and the second end which is operable via a wireless signal. The disclosure additionally includes a blocking mechanism on the band and configured to block a depression of the trigger and operable via the locking mechanism. The disclosure further includes a safety button on the band configured to engage the blocking mechanism when depressed and released via the wireless signal.

18 Claims, 6 Drawing Sheets

(56) References Cited

U.S. PATENT DOCUMENTS

| | | | | |
|---|---|---|---|---|
| 7,266,921 | B2 * | 9/2007 | McClellan | F41A 17/54 42/70.11 |
| 7,971,381 | B1 * | 7/2011 | Mikell | F41A 17/30 42/70.11 |
| 9,016,533 | B2 * | 4/2015 | Visalli | F41C 33/0263 42/70.11 |
| 9,677,835 | B1 * | 6/2017 | Binns | F41A 17/54 |
| 10,401,106 | B1 * | 9/2019 | McMurray | F41A 17/02 |
| 10,816,291 | B1 * | 10/2020 | Silverthorne | F41A 17/02 |
| 2003/0102273 | A1 * | 6/2003 | McMurray | A47F 5/0861 211/5 |
| 2004/0011093 | A1 * | 1/2004 | Fantl | F41A 17/44 70/53 |
| 2008/0066504 | A1 * | 3/2008 | Matsushita | B65D 63/10 70/58 |
| 2008/0134556 | A1 * | 6/2008 | Remelin | F41A 17/066 42/70.07 |
| 2011/0010978 | A1 * | 1/2011 | Hooks | F41A 19/39 42/69.01 |
| 2016/0377362 | A1 * | 12/2016 | Farr | F41A 17/54 42/70.06 |
| 2017/0067709 | A1 * | 3/2017 | Post | F41A 17/063 |
| 2019/0330884 | A1 * | 10/2019 | Reeves | E05B 41/00 |
| 2021/0325135 | A1 * | 10/2021 | Eckelkamp | F41A 17/54 |
| 2022/0178637 | A1 * | 6/2022 | Hamilton | B60R 7/14 |

* cited by examiner

SHORT-RANGE WIRELESS ELECTRONIC LOCK

BACKGROUND

Frequently you hear of a child or someone being shot with a firearm from it accidentally being shot. Or reports of misconduct with a firearm from those who don't know how to use it or are careless with the firearm. There are many statistics about these misuses and accidents with guns. There have been no products available as original equipment or as an aftermarket to address this problem.

An apparatus or device to effectively eliminate accidental discharge or misuse of a firearm. There have been no products available as original equipment or as an aftermarket to address this problem either.

There exists a need for a device or apparatus such as this Short-Range Wireless Electronic Lock that is not being met by any known or disclosed device or system of present.

SUMMARY OF THE INVENTION

The present invention overcomes the above referred to difficulties in a convenient, simple and efficient manner by providing a Short-Range Wireless Electronic Lock. Thus, the apparatus will prevent future misuse or accidental firing of the weapon it is secured upon.

A firearm lock comprising a band having a first end and a second end configured to form a continuous loop around a firearm handle and trigger. The disclosure also includes a locking mechanism connecting the first end and the second end which is operable via a wireless signal. The disclosure additionally includes a blocking mechanism on the band and configured to block a depression of the trigger and operable via the locking mechanism. The disclosure further includes a safety button on the band configured to engage the blocking mechanism when depressed and released via the wireless signal.

Figure 1:
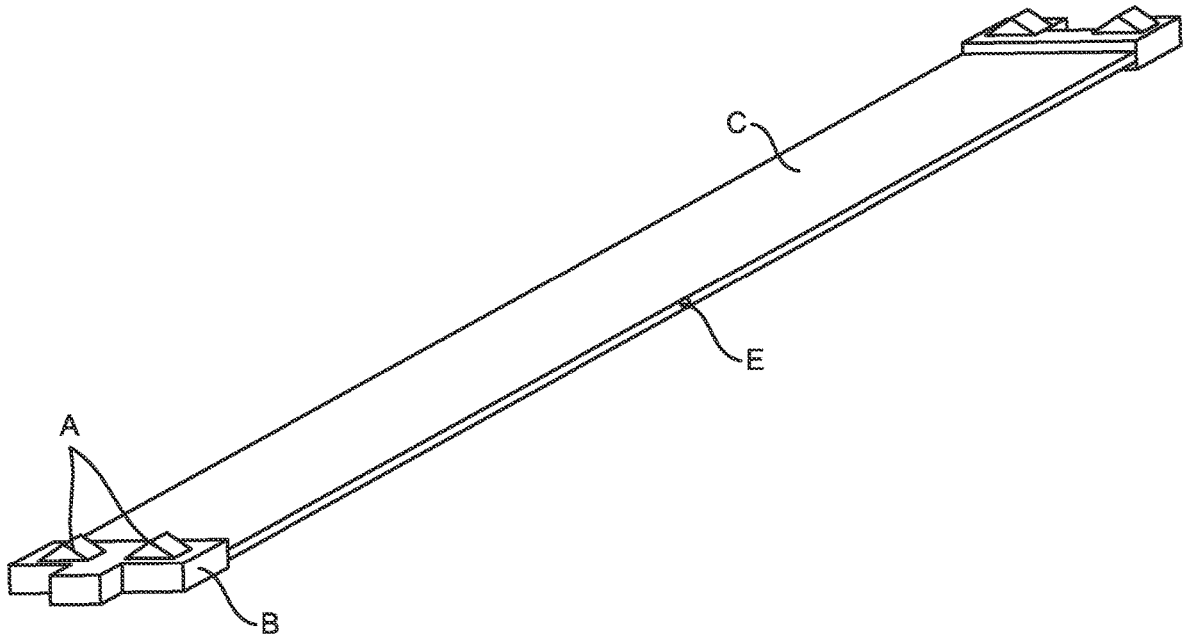
FIG. 1 is a side perspective view of a disassembled Short-Range Wireless Electronic Lock apparatus in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a side perspective view of a disassembled Short-Range Wireless Electronic Lock showing: Blocking mechanism operated by APP via Bluetooth referenced as A., Magnetic lock operated by APP via Bluetooth referenced as B., Metallic Mesh band referenced as C., Safety button referenced as E., in accordance with an embodiment of the present disclosure.

Figure 2:
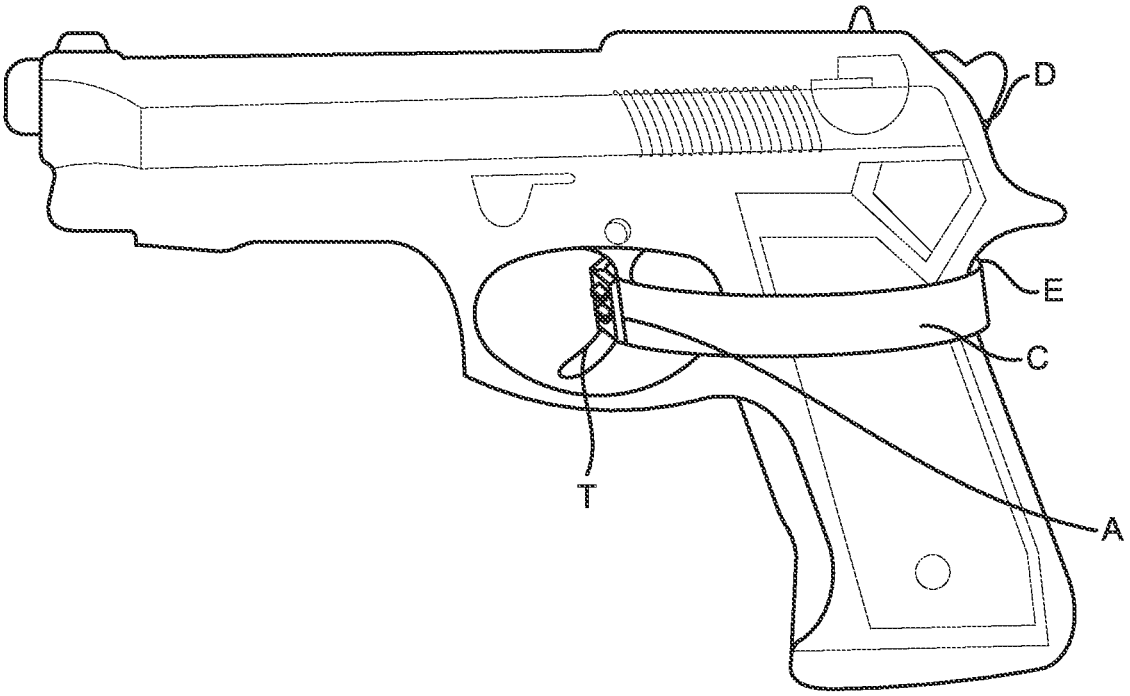
FIG. 2 is a side perspective view of an assembled Short-Range Wireless Electronic Lock apparatus in accordance with an embodiment of the present disclosure.

FIG. 2 is a side perspective view of an assembled Short-Range Wireless Electronic Lock showing: Blocking mechanism operated by APP via Bluetooth referenced as A., Metallic Mesh band referenced as C., Fire arm referenced as D., Trigger T, and Safety button referenced as E., in accordance with an embodiment of the present disclosure.

Figure 3:
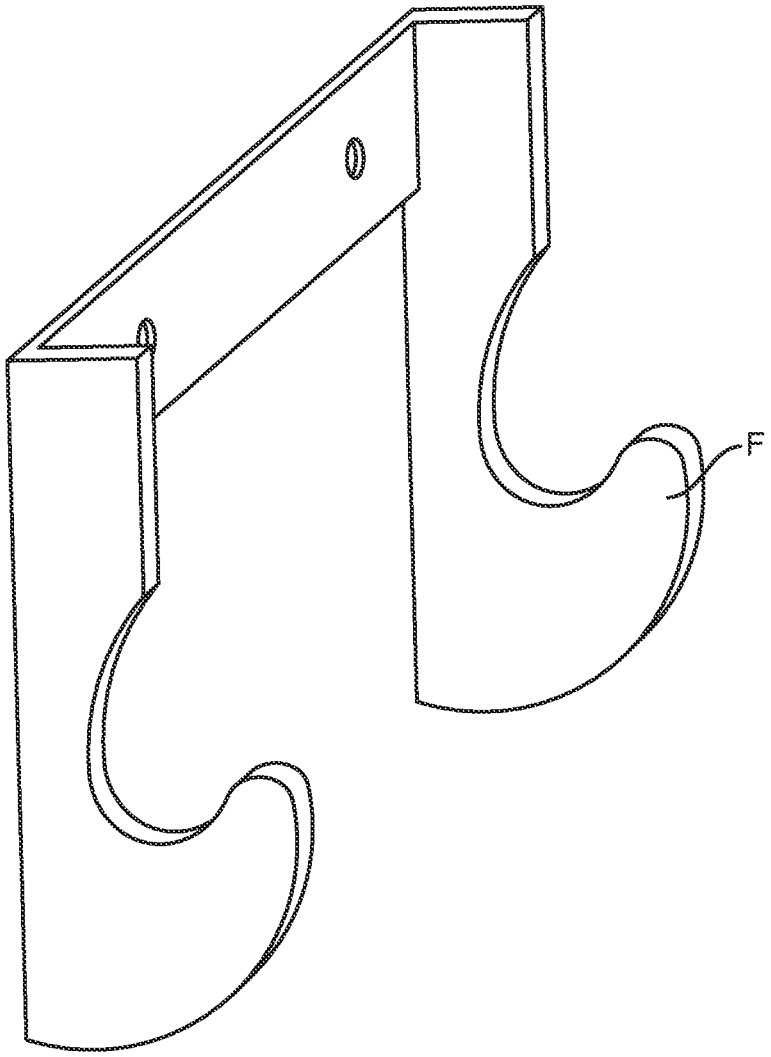
FIG. 3 is a side perspective view A Short-Range Wireless Electronic Lock apparatus rack in accordance with an embodiment of the present disclosure.

FIG. 3 is a side perspective view of A Short-Range Wireless Electronic Lock apparatus rack showing: Rack/mount referenced as F., in accordance with an embodiment of the present disclosure.

Figure 4:
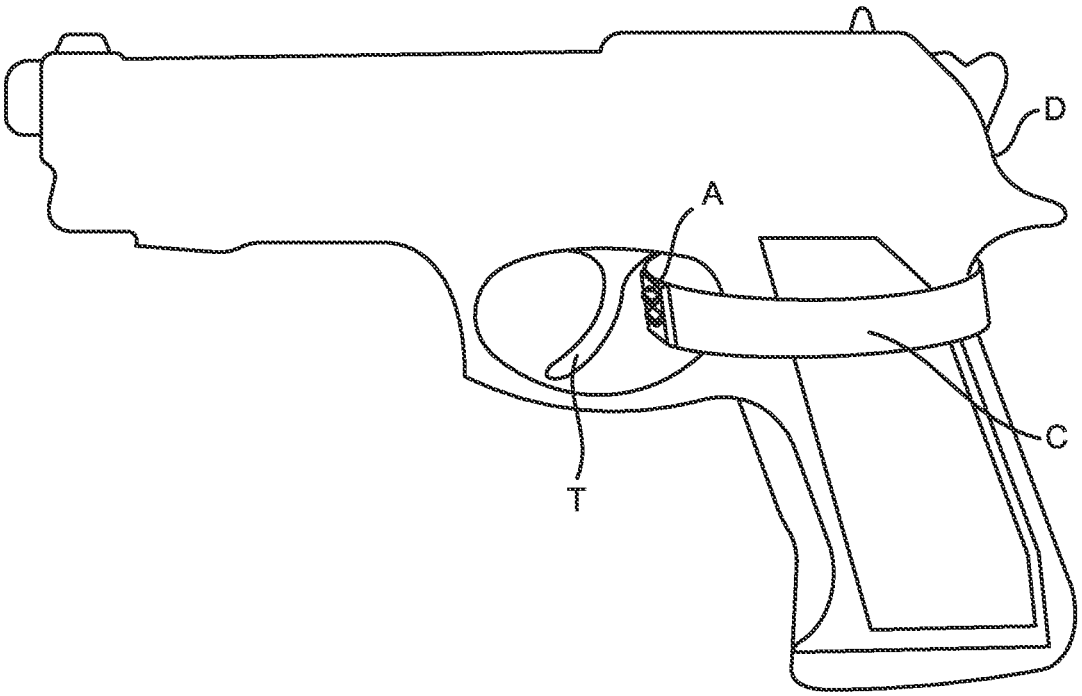
FIG. 4 is a side perspective of an assembled Short Range Wireless Electronic lock showing the band inside of the trigger in accordance with an embodiment of the present disclosure.

FIG. 4 is a side perspective of an assembled Short Range Wireless Electronic lock showing the band inside of the trigger in accordance with an embodiment of the present disclosure. The blocking mechanism A are configured against a back of the undepressed trigger T and prevent its depression.

Figure 5:
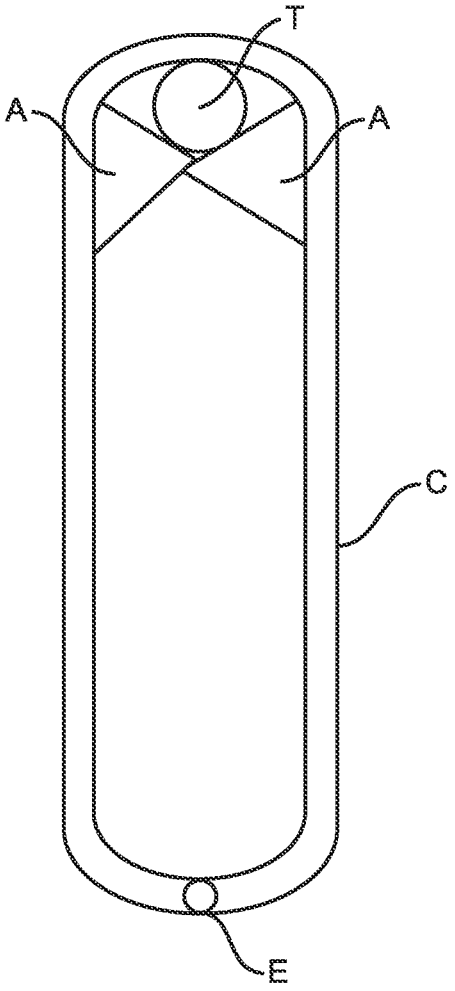
FIG. 5 is a top assembled loop perspective of the Short Range Wireless Electronic lock showing the trigger in cross section blocked inside by the blocking mechanisms on the band in accordance with an embodiment of the present disclosure.

FIG. 5 is a top assembled loop perspective of the Short Range Wireless Electronic lock showing the trigger T in cross section blocked inside by the blocking mechanisms A on the band C in accordance with an embodiment of the present disclosure. The only way therefore to depress the trigger T is to disassemble or unloop the band C via a wireless signal from a cell phone or other remote device.

Figure 6:
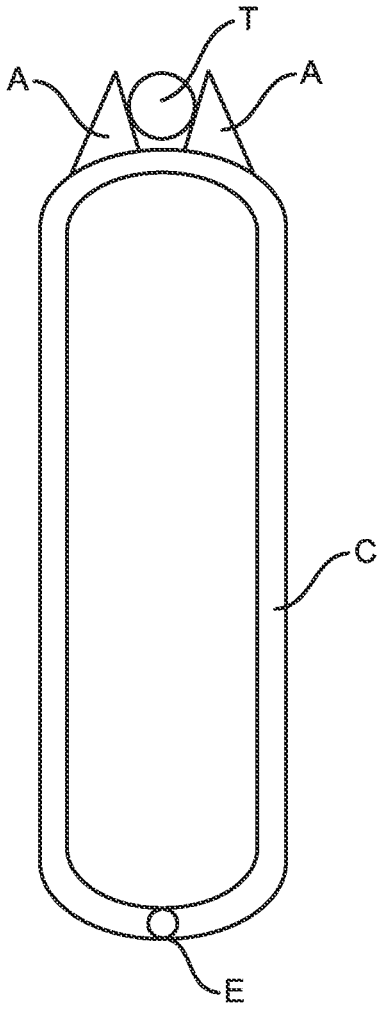
FIG. 6 is a top assembled loop perspective of the Short Range Wireless Electronic lock showing the trigger in cross section blocked outside the band by the blocking mechanisms on the band in accordance with an embodiment of the present disclosure.

FIG. 6 is a top assembled loop perspective of the Short Range Wireless Electronic lock showing the trigger T in cross section blocked outside the band by the blocking mechanisms A on the band C in accordance with an embodiment of the present disclosure. The band is a rigid metal construction that will prevent the trigger depressing into the firearm.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A firearm lock comprising:

a band having a first end and a second end configured to form a continuous loop around a firearm handle and trigger;

a locking mechanism connecting the first end and the second end and operable via a wireless signal;

a blocking mechanism on the band and configured to block a depression of the trigger and operable via the locking mechanism; and a safety button on the band configured to engage the blocking mechanism when depressed and released via the wireless signal.

2. The firearm lock of claim 1, wherein the band comprises a metal mesh.

3. The firearm lock of claim 1, wherein the wireless signal is transmitted from a cell phone.

4. The firearm lock of claim 1, wherein the wireless signal is generated from a cell phone application program.

5. The firearm lock of claim 1, wherein the locking mechanism is electromagnetic.

6. The firearm lock of claim 1, wherein the blocking mechanism comprises triangular protuberances on an inner side of the band which lock behind the trigger based on an assemblage of the band into a loop.

7. The firearm lock of claim 1, wherein the blocking mechanism comprises protuberances on an inner side of the band which lock behind the trigger in response to the wireless signal.

8. The firearm lock of claim 1, wherein the blocking mechanism comprises protuberances configured to raise and lower from and into the band respectively based on the wireless signal.

9. The firearm lock of claim 1, wherein the first end dovetails into the second end and are locked together via a pin running through the dovetail.

10. The firearm lock of claim 1, wherein the blocking mechanism comprises sharp protuberances on an outside of the band and configured to discourage depressing the trigger.

11. The firearm lock of claim 1, wherein the blocking mechanism comprises protuberances on both an inner side and an outer side of the band.

12. The firearm lock of claim 1, wherein the band is a non-magnetic solid metal.

13. The firearm lock of claim 1, wherein the blocking mechanism defines a trap space for the trigger in a non-depressed state.

14. The firearm lock of claim 1, wherein the safety button is in communication with the locking mechanism.

15. The firearm lock of claim 1, wherein the safety button is in communication with the blocking mechanism.

16. The firearm lock of claim 1, wherein the band is configured to form a continuous loop around the firearm handle and between the trigger and the firearm handle.

17. The firearm lock of claim 1, wherein the band comprises triangular protuberances which lock behind the trigger and hold it in a non-depressed state.

18. The firearm lock of claim 1, wherein the band comprises a rough inner surface which is resistant to movement when looped around the firearm handle.

* * * * *